US005151843A

United States Patent [19]

Sanetra et al.

[11] Patent Number: 5,151,843

[45] Date of Patent: Sep. 29, 1992

[54] SENSITIZER FOR FERROMAGNETIC MARKERS USED WITH ELECTROMAGNETIC ARTICLE SURVEILLANCE SYSTEMS

[75] Inventors: Jurgen Sanetra; Heinrich Schug, both of St. Paul, Minn.

[73] Assignee: Minnesota Mining and Manufacturing Company, St. Paul, Minn.

[21] Appl. No.: 447,666

[22] Filed: Dec. 8, 1989

[51] Int. Cl.[5] ..... H01F 13/00

[52] U.S. Cl. ..... 361/149; 335/284; 361/267

[58] Field of Search ..... 361/143, 146, 149, 152, 361/267, 151, 155, 156; 335/284, 296, 297; 340/551, 572; 307/101

[56] References Cited

U.S. PATENT DOCUMENTS

| | | | |
|---|---|---|---|
| 2,786,897 | 3/1957 | Schwarz | 335/284 |
| 3,428,613 | 12/1968 | Trikilis | 335/284 |
| 3,467,926 | 9/1969 | Smith | 335/284 |
| 3,665,449 | 5/1972 | Elder et al. | 340/280 |
| 4,384,313 | 5/1983 | Steingroever et al. | 361/149 |
| 4,499,444 | 2/1985 | Heltemes et al. | 335/284 |
| 4,665,387 | 5/1987 | Cooper et al. | 340/572 |
| 4,684,930 | 8/1987 | Minasy et al. | 340/551 |
| 4,710,754 | 12/1987 | Montean | 340/572 |
| 4,746,908 | 5/1988 | Montean | 340/551 |
| 4,752,758 | 6/1988 | Heltemes | 335/284 |
| 4,825,197 | 4/1989 | Church et al. | 340/572 |

FOREIGN PATENT DOCUMENTS

3014667A1 10/1981 Fed. Rep. of Germany .

*Primary Examiner*—A. D. Pellinen
*Assistant Examiner*—David Osborn
*Attorney, Agent, or Firm*—Gary L. Griswold; Carolyn A. Bates; Peter Forrest

[57] ABSTRACT

An apparatus for use with magnetically based electronic article surveillance systems employing certain types of markers includes a hollow core having a gap in its perimeter, a coil of wire wrapped around a portion of the core, and appropriate circuitry to drive the combination as an electromagnet. The gap configuration produces an external field of large intensity but limited range, such that the magnetizable portion of a marker is magnetized without affecting magnetic states of the article to which the marker is affixed. Depending on the nature of the circuit, the apparatus may be used as a desensitizer of such markers, or preferably as a resensitizer. The resensitizer incorporates a proportional-integral controller that keeps the level of the alternating current constant.

5 Claims, 3 Drawing Sheets

Fig. 4A
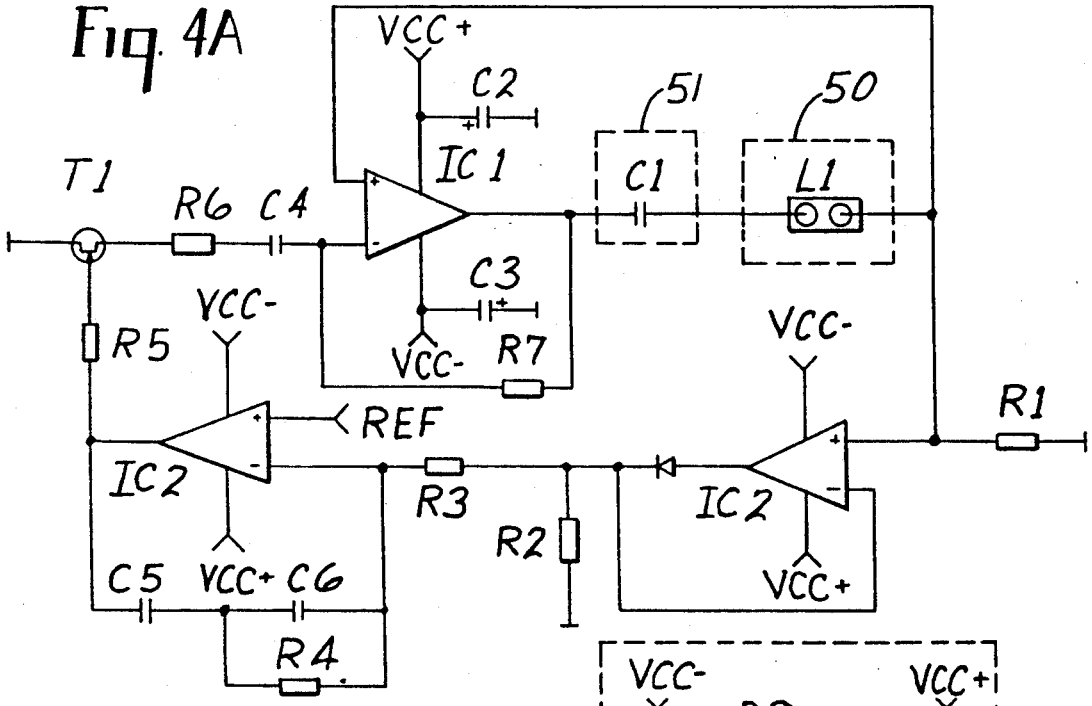
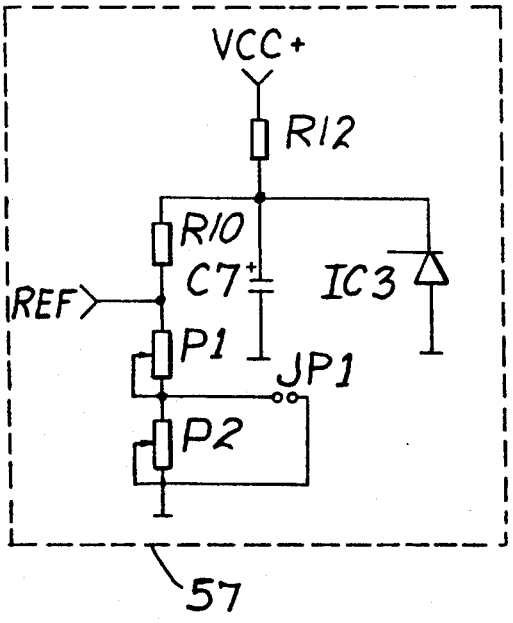
Fig. 4B
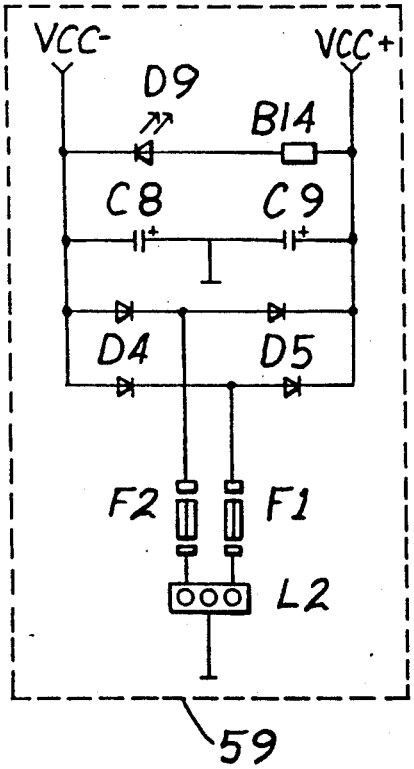
Fig. 4C

SENSITIZER FOR FERROMAGNETIC MARKERS USED WITH ELECTROMAGNETIC ARTICLE SURVEILLANCE SYSTEMS

TECHNICAL FIELD

This invention relates to electromagnetic article surveillance (EAS) systems of the type in which an alternating magnetic field is applied within an interrogation zone, and the presence of a high-permeability low-coercive force ferromagnetic marker within the zone is detected based on signals produced by the marker in response to the applied field. The present invention is directed to an apparatus for changing the response of such markers.

BACKGROUND

In one type of EAS system, the marker includes both a high-permeability low-coercive force portion, and at least one magnetizable section having a higher coercive force than the low-coercive force portion. When the higher coercive force section is magnetized, it alters the detectable signal otherwise produced. Such markers are known as "dual status" markers. An example of a dual status marker is taught in U.S. Pat. No. 4,825,197 (Church and Heltemes).

EAS systems of this type are, for example, disclosed and claimed in U.S. Pat. No. 3,665,449 (Elder and Wright). As they set forth at column 5, lines 10 to 39, a dual status marker of the type described above may be "sensitized"(i.e., the higher coercive force section demagnetized) by placing the marker in a large AC field, and gradually withdrawing the marker.

German Offenlegungsschrift DE 30 14 667 Al (Reiter) depicts a type of desensitizer employing a resistive-inductive-capacitive (RLC) circuit to produce magnetic fields which steadily alternate in polarity and decrease in magnitude. The magnetic fields are produced by winding the inductive coils around rib-like cores arranged about the desensitization region. The directions of the windings around the coils alternate, and thus the polarities of the magnetic fields produced alternate. Thus, when the circuit is activated, sharply defined magnetic zones of alternating polarity arise, through which the article affixed with a marker may be passed.

While such techniques may be useful for the markers affixed to a wide variety of articles, the magnetic fields required for effective resensitization interfere with magnetic states associated with certain articles. For example, the compact size and popularity of prerecorded magnetic audio and video cassettes make such articles frequent targets for shoplifters, and hence likely articles on which EAS markers would be affixed. However, in a rental situation, when such markers are resensitized upon return from rental, a resensitizer apparatus as described above may unacceptably affect the signals prerecorded on the magnetic tapes within the cassettes. Similarly, magnetic disks (flexible or otherwise) or any other magnetic data storage medium may be affected by the resensitizer apparatus.

Commercial embodiments of resensitizers are the Model 950 and 951 resensitizers available from the Minnesota Mining and Manufacturing Company (3M). Another embodiment is taught in U.S. Pat. No. 4,752,758 (Heltemes).

DISCLOSURE OF INVENTION

The apparatus of the present invention comprises a ferromagnetic core having two surfaces which face, but do not touch, each other and thereby define a gap. Optionally, the gap may be formed by surfaces of a pair of pole pieces which concentrate external magnetic flux. Furthermore, the core is wrapped with wire, forming an apparatus which may be driven by an electric circuit to produce a magnetic field in the gap. Preferably, an alternating current source is used, in which case a sinusoidal magnetic field is created and the apparatus operates as a resensitizer. However, if a direct current source is used, the present invention may be used as a desensitizer.

BRIEF DESCRIPTION OF THE DRAWING

FIGS. 4A, 4B, and 4C are electronic schematic diagrams of one embodiment of a circuit portion of the invention.

DETAILED DESCRIPTION

Figure 1:
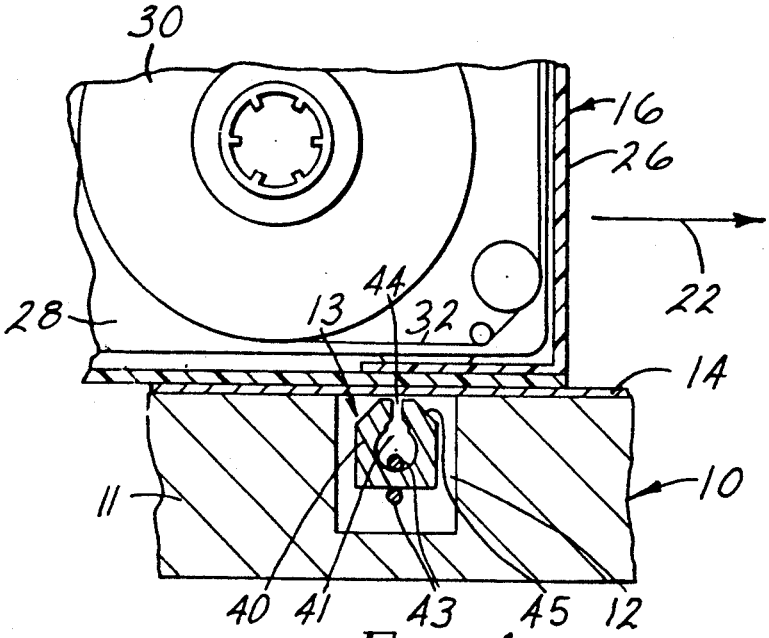
FIG. 1 is a cross sectional view of an embodiment of the invention.

As shown in FIG. 1, the present invention may be in the form of an apparatus 10 having a housing 11 and a concealed cavity 12. The cavity 12 is covered by a non-magnetic cover plate 14 which both covers and protects an assembly 13 in the cavity 12.

In using the apparatus 10, as shown in FIG. 1, an article 16 is moved in the direction shown by arrow 22 so that a resensitizable marker (not shown) which is affixed to the exterior of the article 16 will pass over the cavity 12, i.e., directly on the cover plate 14. The apparatus 10 may be used with the working surface established by the cover plate 14 in a horizontal position, such that the article 16 may be moved across the horizontal surface.

The housing 11 of the apparatus 10 is preferably constructed from non-magnetic materials, e.g., finished hardwood, injection-molded plastic, or non-magnetic metals. The housing 11 may carry appropriate legends, manufacturer identification, instructions, and the like.

The cover plate 14 provides a surface over which articles affixed with resensitizable markers may be passed during use of the apparatus. For example, such a cover plate 14 may comprise polished stainless steel having a thickness in the range of 0.1 mm. The cover plate 14 should be polished metal, as such a surface resists scratching or chipping, and thus remains aesthetically acceptable even over many cycles of use.

The marker typically comprises a piece of a high-permeability, low-coercive force ferromagnetic material such as permalloy, certain amorphous alloys, or the like. The marker further comprises one or more high-coercive force magnetizable sections in the immediate vicinity of the low-coercive force material. These sections typically are a material such as vicalloy, silicon steel, "ARNOKROME"(a tradename of the Arnold Engineering Company) or the like, having a coercive force in the range of 0.25 to 3.0 Ampere/meter (A/m). When such sections are magnetized, the residual fields produced magnetically bias the low-coercive force material. This bias substantially alters the signal response produced by the marker in the presence of an interrogating field. To demagnetize the sections, they are brought into close proximity with the assembly 13 within cavity 12, and then moved away.

The assembly 13 is located in the cavity 12. The cavity 12 is bounded by the housing 11 and the cover plate 14, and open to the latter. The cavity 12 is open to the surface of the apparatus 10, save for the cover plate 14 if one is employed.

For illustrative purposes, the article 16 includes an outer enclosure 26, and a prerecorded audio cassette 28. The cassette 28 includes a reel of magnetic tape 30 having one portion 32 passing along a tape path in the vicinity of the assembly 13. The configuration of the article 16 thus presents a worst case: a portion of the tape 32 may be relatively close to the assembly 13, such that the fields which demagnetize the sections could unacceptably affect the magnetic states of the tape 30, but for the special configuration of the assembly 13.

As shown in FIG. 1, the assembly 13 comprises a high-permeability core 40 which in cross section is substantially continuous around a core interior 41, or "ring shaped," except for a gap 44. The gap 44 is adjacent the surface of the apparatus 10. The length of gap 44, measured from one face to the other, is substantially less than the length of the magnetic circuit around the core interior 41. The assembly 13 further comprises a conductor 43 wound around the core 40. In practice, the conductor 43 is many turns of wire, but for clarity in FIG. 1, only a single winding is shown.

The conductor 43 is electromagnetically coupled to the core 40 and is electrically connected to an electrical current source (not shown). When current passes through the conductor 43, a magnetizing field along the magnetic circuit of the core 40 induces magnetic flux throughout the magnetic circuit, and across the gap 44. The optional bevels 45 in the core 40 concentrate the magnetic flux in the vicinity of the gap 44. However, because the magnetic flux density in the low-permeability gap 44 is substantially less than that in the high-permeability core 40, the magnetic flux "leaks" into regions adjacent the gap 44.

This produces a magnetic field in the direction across the gap which decreases rapidly with perpendicular distance above the gap, and the rate of decrease can be controlled by the selection of gap length. In use, a magnetically sensitive article such as an appropriately boxed prerecorded cassette may be positioned above the working surface of the resensitizer apparatus as shown in FIG. 1 and the prerecorded tape will never be closer than approximately 6 mm from the gap 44 as shown in FIG. 1. In contrast, the high-coercive force sections of the marker will typically be separated from the assembly 13 only by the thickness of the cover plate 14 (i.e., about 0.1 mm) and will thus typically be exposed to a much greater field intensity. Also, magnetic recording media typically have a coercive force of 3.75–8.75 A/m. Therefore, the magnetic fields required to resensitize the marker can leave the prerecorded signals on the tape unaffected.

The current source may be direct current, in which case the apparatus operates as a desensitizer of markers. The marker may be moved relative to the gap to expose the section of high coercive force material within the marker to a large magnetic field. As before, the external field intensity extending beyond a short distance from the gap is insufficient to alter a magnetic state which may exist within an article to which the marker is secured. In the preferred embodiment, alternating current is used and the apparatus operates as a resensitizer of previously desensitized markers.

Because the conductor is wound around the magnetic assembly, the conductor may be treated as an inductive coil. Using this concept, a resistor and capacitor can be added in series or in parallel with the conductor to create an RLC circuit with a resonant frequency determined by the appropriate electrical properties of the components.

In general terms, it is preferred that the resensitizer operate effectively when the marker is passed over the gap 44 at a speed of approximately 60 cm/s or less. Non-inventive systems in current use operate effectively at recommended marker speeds of no more than about 8 cm/s. Thus, the preferred resonant frequency of the RLC circuit is 1 KHz or greater, to ensure that a sufficient number of reversals of the field occurs while the marker 18 is being drawn out of the effective range of the assembly 13. The actual frequency preferred depends on the speed at which the marker is passed, and the amount of decrease in field strength as a function of distance from the gap. It is preferred that the marker is exposed to a field in which the field strength has a "drop rate" of no more than about 25% of the previous cycle of the AC field. The drop rate can be halved by doubling the frequency.

In selecting a frequency, the change in inductance of the circuit which occurs as the marker is passed over the gap should be taken into account. This generally means driving the circuit at a reference frequency which is slightly less than the calculated resonant frequency, so that the current in the circuit is maximized as the marker is centered over the gap. Selection of the reference frequency can be done through tests with actual markers being used.

With certain types of markers, it is preferred to shield the assembly and marker from extraneous fields, such as the earth's magnetic field. Shielding the marker is often not practical, but shielding the assembly is possible using procedures and materials known in the art.

A suitable core 40 in the configuration of FIG. 1 was made from 170 laminations of approximately 0.36 mm thick transformer steel, for a total width (i.e , measured perpendicular to the plane of FIG. 1) of approximately 61.2 mm. The gap length was 2.54 mm, and the assembly was wrapped with sixty turns of #23 AWG enameled wire. Currents on the order of 1.44 to 2.03 amperes were suitable for producing fields in the direction across the gap of about 0.5–1.0 A/m at 6 mm height above the gap, and about 1.5–2.0 A/m at about 0.25 mm height. The particular embodiment would produce a field of up to the desired 3 A/m if a higher current were used.

Figure 2A:
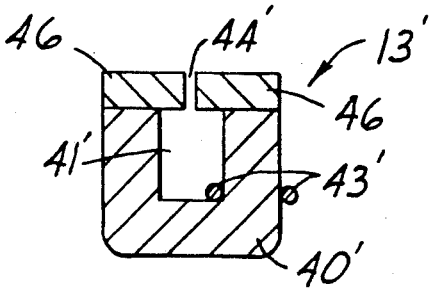
FIGS. 2A, 2B, and 2C are cross sectional views of alternative embodiments of a portion of the invention.

An alternative configuration for the core is shown in FIG. 2A. The alternative assembly is designated as 13', and portions of it which serve analogous roles to numbered portions of FIG. 1 are similarly designated with primed numerals. The core 40' is essentially "U-shaped" in cross section, and defines core interior 41'. The assembly 13' as shown employs optional pole pieces 46 to define gap 44' and concentrate magnetic flux. The assembly 13' of FIG. 2A, including pole pieces 46, has a preferred gap length of 1 mm, but other lengths are possible by adjusting the size and/or positioning the pole pieces 46.

Figure 2B:
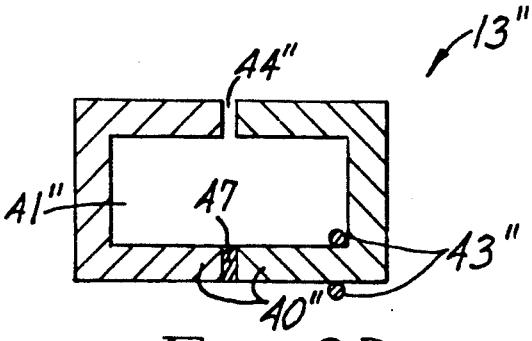
Figure 2C:
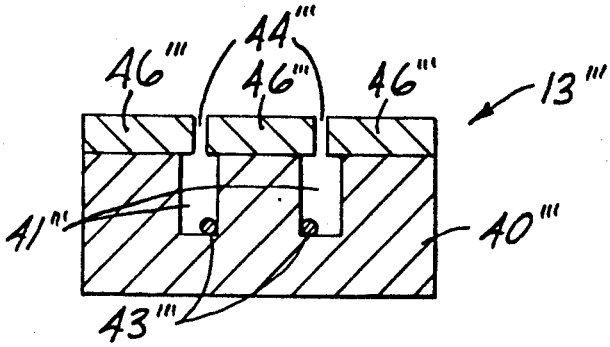

Other configurations for the core are possible. For example, as shown in FIG. 2B, the U-shaped cores 41'' may be butted together and sealed at one leg by a sealer 47 to form a gap 44" at the other leg. Then a conductor 43" is wrapped around the exterior of the assembly 13" and the core interior 41". As shown in FIG. 2C, assembly 13''' comprises an "E-shaped" core 40''' which has two gaps 44'''. In this embodiment the conductor 43''' is wound within the two interior regions 41'''. As shown, optional pole pieces 46''' define gaps 44'''.

Assemblies constructed according to the designs of FIGS. 2A, 2B, and 2C may be assembled from commercially available ferrite cores, as opposed to custom-made assemblies. However, an assembly 13 constructed according to the embodiment of FIG. 1 is preferred because it exhibits less field strength measured at the side of the gap, as a percentage of that measured directly above the gap, than an assembly 13' constructed according to the embodiment of FIG. 2A. For representative core assemblies, the former value was approximately 6% as opposed to approximately 20% for the latter.

Figure 3:
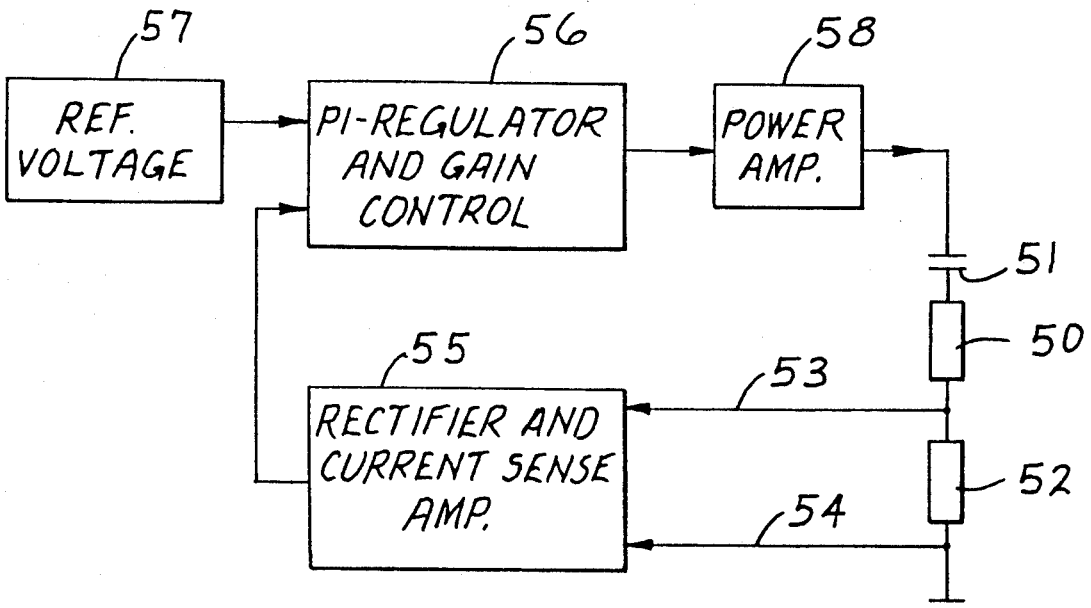
FIG. 3 is a block diagram of an embodiment of a circuit portion of the invention.

FIG. 3 is a block diagram of a suitable circuit for use with the embodiment of FIG. 2A. In this circuit, a current controlled oscillator holds the current in the coil 50 constant. The coil 50 is in series with a capacitor 51 and a current sense resistor 52. The current in the coil 50 is detected by determining the voltage drop across the sense resistor 52, i.e., the voltage between sense wires 53 and 54. This voltage drop serves as feedback into a control circuit 56 through a rectifier and current sensing amplifier 55. The control circuit 56 is a proportional-integrating circuit which compares the feedback voltage with a precision voltage reference 57. If these voltages are equal, the circuit resonates at the resonant frequency established by the values of the capacitor 51 and coil 50. A power amplifier 58 compensates for the power loss of the resonating circuit. This circuit shows very good independence of resonant frequency with changes in ambient temperature over the range of 20 to 60° C., and relatively good independence of gap field intensity with changes in ambient temperature over the range of 20 to 40° C.

FIG. 4A shows an example of a circuit built according to the block diagram of FIG. 3, suitable for use with the assembly of FIG. 2A. The circuit of FIG. 4A is powered by the circuit of FIG. 4C, which corresponds to the power supply 59 of FIG. 3, and which produces suitable positive and negative operating voltages (e.g., ±15 VDC) and ground level. In FIG. 4B, a circuit corresponding to precision voltage reference 57 of FIG. 3 is shown, including potentiometers P1 and P2 and jumper JP1, which allow for adjustment of the reference voltage in the circuit of FIG. 4A.

Suitable exemplary components for this circuit are shown in Table I, below, but variations known to those skilled in the art are acceptable. In general, the components are of relatively low tolerance and cost, as the circuit automatically adjusts for the proper resonant frequency despite the component tolerances.

TABLE I

| Item | Component | Value or Model. Tolerance. Rating |
|---|---|---|
| R1 | Resistor | Buerklin MPC70-OR22-2 W 10% 1 W |
| R2 | Resistor | 6K81 1% 0.25 W |
| R3 | Resistor | 150K 1% 0.25 W |
| R4 | Resistor | 33K2 1% 0.25 W |
| R5 | Resistor | 100K |
| R6 | Resistor | 12K1 1% 0.25 W |
| R7 | Resistor | 221K 1% 0.25 W |
| R10 | Resistor | 100K |
| R12 | Resistor | 3K32 1% 0.25 W |

TABLE I-continued

| Item | Component | Value or Model. Tolerance. Rating |
|---|---|---|
| R14 | Resistor | 2K21 1% 0.25 W |
| P1, P2 | Potentiometer | Piher PT10H-10K (DIN 41450) 10% |
| D1 | Diode | Valvo/TI 1N4148 |
| D2-5 | Diode | Valvo/TI 1N4001 |
| D9 | LED | Green. 5 mm |
| C1 | Capacitor | Siemens B32650-L3225-1 5% 400 V |
| C2, C3 | Capacitor | 10uF 20% 25 V |
| C4 | Capacitor | AVX 100N 20% 50 V |
| C5 | Capacitor | AVX 10N 20% 50 V |
| C6 | Capacitor | AVX 3N3 20% 50 V |
| C7 | Capacitor | 1uF 20% 25 V |
| C8, C9 | Capacitor | Siemens B41010-05108-T 1000uF 50% 25 V |
| T1 | Transistor | Valvo BF245A |
| IC1 | Int. Circuit | SGS TDA2040 V |
| IC2 | Int. Circuit | TI T1082P |
| IC3 | Int. Circuit | Thomson LM336A |
| F1, F2 | Fuse | Buerklin OG (G146, 520) 250 V |

A variety of embodiments and alternative configurations of the apparatus of the present invention are possible, including the use of a variety of wire types, number of turns, and the like; a variety of pole piece configurations; and a variety of driving circuits. The width of the gap is substantially unlimited, it being limited only by the width of the core and pole pieces (if used) provided. Thus, an apparatus according to the present invention may be constructed having variable length gaps, or varying width gaps. Furthermore, the core need not have parallel faces forming the gap as shown in the figures, but may have beveled or tapered faces to focus magnetic flux, as is known in the art.

We claim:

1. A resensitizer apparatus adapted for use with an electronic article serveillance system for detecting a resensitizable marker secured to a moving article, in which the marker includes a first, low-coercive force, high-permeability ferromagnetic material and at least one section of a remanently magnetizable, relatively higher coercive force material which when magnetized magnetically biases the low coercive force material and thereby alters the detectability of the marker; the resensitizer apparatus comprising:

(a) an assembly comprising at least one section of a second ferromagnetic material having two substantially opposed major surfaces, the surfaces facing but not touching each other such that a gap exists between the surfaces;

(b) a conductor wound around outer and inner portions of the second ferromagnetic material; and (c) an alternating current source capable of driving the assembly at a constant maximum amplitude such that the assembly concentrates external magnetic lines of flux near the gap to produce a sufficient number of field reversals in a spatially decreasing magnetic field outside the gap to resensitize the marker while the marker is moving away from the gap, the current source comprising:

(1) a coil in series with a capacitor and a current sense resistor;

(2) means for determining a voltage drop across the sense resistor and using the voltage drop as feedback into a proportional-integral control circuit which compares the voltage drop to a precision voltage reference and hold the amplitude of the alternating current in the coil at a constant level.

2. The apparatus of claim 1, further comprising a housing having a surface adapted to support an article as a marker affixed to the article is moved past the gap, and a cavity within which the assembly is positioned so that the gap of the assembly is substantially coplanar with the surface.

3. The apparatus of claim 2, further comprising a thin non-magnetic metallic plate covering the surface.

4. The apparatus of claim 1, in which the article comprises a prerecorded magnetic recording medium.

5. The apparatus of claim 1, in which the current source further compensates for power loss in the series circuit of the coil, capacitor, and current source resistor.

* * * * *